US010883362B2

(12) United States Patent
Nesgaard

(10) Patent No.: US 10,883,362 B2
(45) Date of Patent: Jan. 5, 2021

(54) DOWNHOLE TRANSFER SYSTEM

(71) Applicant: WELLTEC OILFIELD SOLUTIONS AG, Zug (CH)

(72) Inventor: Carsten Nesgaard, Zug (CH)

(73) Assignee: Welltec Oilfield Solutions AG, Zug (CH)

( * ) Notice: Subject to any disclaimer, the term of this patent is extended or adjusted under 35 U.S.C. 154(b) by 0 days.

(21) Appl. No.: 16/444,327

(22) Filed: Jun. 18, 2019

(65) Prior Publication Data

US 2019/0383136 A1 Dec. 19, 2019

(30) Foreign Application Priority Data

Jun. 19, 2018 (EP) ..... 18178567

(51) Int. Cl.

| | |
|---|---|
| ***E21B 47/13*** | (2012.01) |
| ***E21B 47/06*** | (2012.01) |
| ***E21B 47/07*** | (2012.01) |
| *E21B 33/12* | (2006.01) |
| *E21B 49/08* | (2006.01) |

(52) U.S. Cl.

CPC ..... *E21B 47/13* (2020.05); *E21B 47/06* (2013.01); *E21B 47/07* (2020.05); *E21B 33/12* (2013.01); *E21B 49/08* (2013.01); *E21B 49/0875* (2020.05)

(58) Field of Classification Search

CPC ... E21B 17/028; E21B 17/02983; E21B 47/13
See application file for complete search history.

(56) References Cited

U.S. PATENT DOCUMENTS

| | | | |
|---|---|---|---|
| 4,901,069 | A | 2/1990 | Veneruso |
| 2004/0238166 | A1 | 12/2004 | Salamitou et al. |
| 2007/0235185 | A1 | 10/2007 | Patel et al. |
| 2010/0052941 | A1 | 3/2010 | Madhavan et al. |
| 2010/0101786 | A1 | 4/2010 | Lovell et al. |
| 2017/0350197 | A1 | 12/2017 | Sugiura et al. |

FOREIGN PATENT DOCUMENTS

| | | |
|---|---|---|
| EP | 2 990 593 | 3/2016 |

OTHER PUBLICATIONS

Extended Search Report for EP18178567.6 dated Nov. 28, 2018, 7 pages.

*Primary Examiner* — Kristyn A Hall

(74) *Attorney, Agent, or Firm* — Nixon & Vanderhye P.C.

(57) ABSTRACT

The present invention relates to a downhole transfer system for transferring data through a well tubular metal structure arranged in a borehole of a well, comprising a well tubular metal structure having an axial direction and being arranged in the borehole providing an annulus between the borehole and the well tubular metal structure, a transceiver assembly comprising a tubular metal part mounted as part of the well tubular metal structure, the tubular metal part having an inner face, an outer face and a wall, an assembly conductive winding, such as a copper ring, connected with the inner face, a power consuming device, such as a sensor, arranged in the annulus and connected with the outer face and the power consuming device is connected to the assembly conductive winding by means of an electrical conductor, a downhole tool comprises a tool body, a tool body outer face and a tool conductive winding, wherein the assembly conductive winding has an axial extension along the axial direction and a radial extension perpendicular to the axial extension, the axial extension being at least 50% larger than the radial extension.

20 Claims, 8 Drawing Sheets

DOWNHOLE TRANSFER SYSTEM

Figure 1:
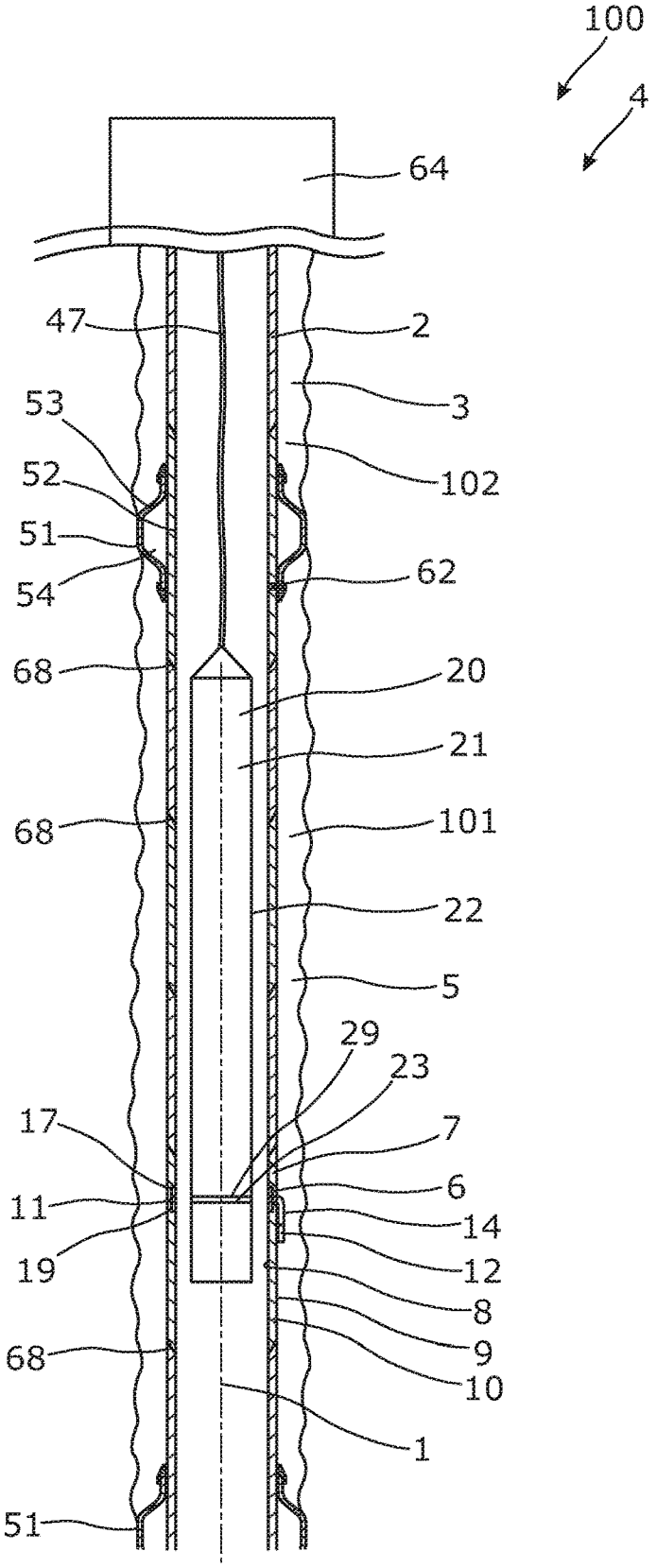

This application claims priority to EP Patent Application No. 18178567.6 filed Jun. 19, 2018, the entire content of which is hereby incorporated by reference.

The present invention relates to a downhole transfer system for transferring data through a well tubular metal structure arranged in a borehole of a well.

When controlling and optimising oil production of a well, the operator needs to gain knowledge of what is flowing through the different production zones in a well. One way of obtaining such knowledge is to measure temperature and pressure in the annulus surrounding the production liner. In order to function, such sensor needs to receive power and therefore electrical control lines are typically run along the production liner to each sensor. But when running the completion, these electrical control lines may become damaged or may become damaged over time and then the sensors do not work. Furthermore, having a wired connection to the sensor would force significant changes to the well tubular structure causing substantial weakening of the completion with a risk of creating e.g. blow-outs or similar uncontrolled occurrences.

When having sensors mounted for measuring a condition or a property outside a well tubular metal structure downhole, the measured data may also be transmitted wirelessly to the surface. The sensors will have to operate autonomously since replacement of power source or service of the sensor downhole is virtually impossible. Furthermore, it is very difficult to ensure these sensors' or instruments' function over time, as the battery power is very limited downhole as the batteries cannot withstand high temperatures and pressures without discharging quickly.

One solution to this problem is presented in EP 3 101 220 A1 by the same applicant. Here, a downhole completion system for wirelessly charging a device outside a well tubular metal structure is described. The system works by having one power receiving coil of a device outside the well tubular metal structure arranged parallel or coincident with a power transmitting coil arranged in a tool inside the well tubular metal structure.

One problem with the prior art is that the efficiency of power transfer to the receiving coil will depend greatly on environmental factors. The temperature of the downhole equipment will cause frequency drift of electronics, which will also be affected by different types of the surrounding medium, e.g. gases, soil types or different concentrations of brine. Furthermore, the download of data from the sensor occurs at a very low rate, i.e. at approximately 50 Hz, and therefore the tool must be located opposite each sensor for a very long period of time which is not appropriate as the oil production is often stopped during such intervention by the tool.

It is an object of the present invention to wholly or partly overcome the above disadvantages and drawbacks of the prior art. More specifically, it is an object to provide an improved downhole transfer system which is able to function without the use of control lines and transmitting data at a higher rate.

The above objects, together with numerous other objects, advantages and features, which will become evident from the below description, are accomplished by a solution in accordance with the present invention by a downhole transfer system for transferring data through a well tubular metal structure arranged in a borehole of a well, comprising:

- a well tubular metal structure having an axial direction and being arranged in the borehole providing an annulus between the borehole and the well tubular metal structure,
- a transceiver assembly comprising:
  - a tubular metal part mounted as part of the well tubular metal structure, the tubular metal part having an inner face, an outer face, and a wall,
  - an assembly conductive winding made from a conductor connected with the inner face,
  - a power consuming device, such as a sensor, arranged in the annulus and connected with the outer face and the power consuming device is connected to the assembly conductive winding by means of an electrical conductor,
- a downhole tool comprises a tool body, a tool body outer face, and a tool conductive winding made from a conductor, wherein the conductor of the assembly conductive winding has a cross-sectional shape having an axial extension along the axial direction and a radial extension perpendicular to the axial extension, the axial extension being at least 50% larger than the radial extension.

The electrical conductor may extend through the wall of the well tubular metal structure in a bore.

Moreover, the conductor of the assembly conductive winding may be a ring having a rectangular cross-sectional shape.

In addition, the axial extension may be at least 3 mm, preferably more than 5 mm.

Furthermore, the radial extension may be less than 1 mm.

Also, the radial extension may be less than 0.2 mm.

Moreover, the radial extension may be as small as possible.

Additionally, the assembly conductive winding may have substantially one turn, so that the conductor of the assembly conductive winding turns from 0° to be equal or less than 360°.

One end of the assembly conductive winding may be electrically connected to the electrical conductor and the other end of the assembly conductive winding may be electrically connected to another electrical conductor.

Furthermore, the transceiver assembly may comprise a transceiver device which comprises the assembly conductive winding having a housing, the electrical conductors being connected with the housing.

In addition, the transceiver assembly may further comprise an intermediate annular sleeve having a groove in which the conductor of the assembly conductive winding is arranged, the intermediate annular sleeve is arranged on the inner face of the tubular metal part and is arranged between the conductor of the assembly conductive winding and the inner face, the intermediate annular sleeve is of a material having a lower electrical conductivity than that of the assembly conductive winding.

Also, the intermediate annular sleeve is of a material having a lower electrical conductivity than that of the well tubular metal structure/the tubular metal part.

Furthermore, the intermediate annular sleeve is of a material having a high permeability to magnetic field lines.

Moreover, the intermediate annular sleeve may be arranged in a groove in the tubular metal part of the well tubular metal structure.

Also, the intermediate annular sleeve may have a length along the axial direction being at least two times the axial extension of the conductor of the assembly conductive winding.

The intermediate annular sleeve may have a length which is more than 50 mm.

Furthermore, the intermediate annular sleeve may be made of ferrite or the like material.

The intermediate annular sleeve may be made of ferrite or the like material hindering magnetic flux lines from extending through the tubular metal part and the well tubular metal structure.

Additionally, the intermediate annular sleeve may hinder magnetic flux lines from extending through the tubular metal part and the well tubular metal structure to avoid generation of Eddy currents.

Moreover, the downhole tool conductive winding may be a one-turn tool conductive winding, the downhole tool comprising a plurality of one-turn tool conductive windings.

In addition, each end of each of the plurality of one-turn tool conductive windings may be electrically connected to an electrical conductor.

The tool conductive winding may be made of copper or similar conductive material.

Furthermore, the transceiver assembly may comprise a plurality of one-turn assembly conductive windings each arranged in a groove of an intermediate annular sleeve.

Additionally, the intermediate annular sleeve may be arranged in a groove in the tubular metal part.

Also, transmission between the tool conductive winding and the assembly conductive winding may be at a frequency of at least 1 MHz, preferably at least 5 MHz, even more preferably at least 10 MHz.

Moreover, the downhole transfer system may have a resonance frequency above 14 MHz.

In addition, the tool conductive winding may have an axial extension along the axial direction and a radial extension perpendicular to the axial extension, the axial extension being at least 50% larger the radial extension.

Furthermore, the conductor of the tool conductive winding may have a rectangular cross-sectional shape having a radial extension along the axial direction and a radial extension, the axial extension being at least 50% larger than the radial extension.

The axial extension of the tool conductive winding may be at least 3 mm, preferably more than 5 mm.

Additionally, the radial extension of the downhole tool conductive winding may be less than 1 mm.

Also, the radial extension of the downhole tool conductive winding may be less than 0.2 mm.

Furthermore, the radial extension of the downhole tool conductive winding may be as little as possible.

In addition, each end of the tool conductive winding may be electrically connected to an electrical conductor.

Moreover, the downhole tool conductive winding may be a one-turn tool conductive winding, the tool comprising a plurality of one-turn tool conductive windings.

Each end of each of the plurality of one-turn tool conductive windings may be electrically connected to an electrical conductor.

In addition, the tool conductive winding may be made of copper or similar conductive material.

Additionally, the downhole tool may comprise a plurality of one-turn tool conductive windings each arranged in a groove of an intermediate annular sleeve.

Moreover, the downhole tool may further comprise an intermediate annular sleeve having a groove in which the tool conductive winding is arranged, the intermediate annular sleeve being arranged on the tool body outer face of the tool body and being arranged between the tool conductive winding and the tool body outer face, the intermediate annular sleeve being of a material having a lower electrical conductivity than that of the tool conductive winding.

Also, the intermediate annular sleeve is of a material having a high permeability to magnetic field lines.

The intermediate annular sleeve may be arranged in a groove in the tool body.

Furthermore, the intermediate annular sleeve may have a length along the axial direction being at least two times the axial extension of the tool conductive winding.

Also, the intermediate annular sleeve may be made of ferrite or the like material hindering magnetic flux lines from extending through the tool body and avoid generation of Eddy currents.

In addition, the intermediate annular sleeve may be made of ferrite or the like material.

The intermediate annular sleeve may hinder magnetic flux lines from extending through the tool body to avoid generation of Eddy currents.

Additionally, the downhole transfer system according to the present invention may further comprise sealing means arranged around the electrical conductors in the wall.

Moreover, the power consuming device may be a sensor unit.

Furthermore, the sensor unit may comprise a power supply, such as a battery, a fuel cell, or may be connected to an electrical control line.

In addition, the sensor unit may comprise a micro controller.

Also, the sensor unit may comprise a storage unit.

The sensor unit may comprise a sensor, such as a temperature sensor, a pressure sensor, or a sensor measuring salinity, fluid content, density, etc.

Additionally, the sensor unit may comprise several sensors.

Moreover, the well tubular metal structure may further comprise a plurality of transceiver assemblies.

Furthermore, the downhole tool may be connected to surface via wireline, thus being a wireline downhole tool.

The downhole tool may comprise a battery or several batteries.

In addition, the downhole tool may be a wireless downhole tool.

Also, the downhole tool may comprise a centraliser, such as a downhole tractor.

Additionally, the downhole tool may comprise a storage means.

Moreover, the downhole tool may comprise an electronic control module.

Furthermore, the assembly conductive winding and the intermediate annular sleeve may be embedded in a permanent coating such as epoxy, rubber, etc.

In addition, the tool conductive winding and the intermediate annular sleeve may be embedded in a permanent coating such as epoxy, rubber, etc.

Moreover, the well tubular metal structure may comprise annular barriers configured to be expanded in the annulus providing isolation between a first zone and a second zone, each annular barrier comprising a barrier tubular metal part mounted as part of the well tubular metal structure, an expandable metal sleeve surrounding and connected with the barrier tubular metal part providing an annular space in which fluid may enter an opening in the barrier tubular metal part to expand the expandable metal sleeve.

Finally, the sensor unit may be arranged in the annulus and configured to measure a property, such as temperature or pressure, on one side of the annular barrier within the well tubular metal structure or within the annular barrier.

Figure 2:
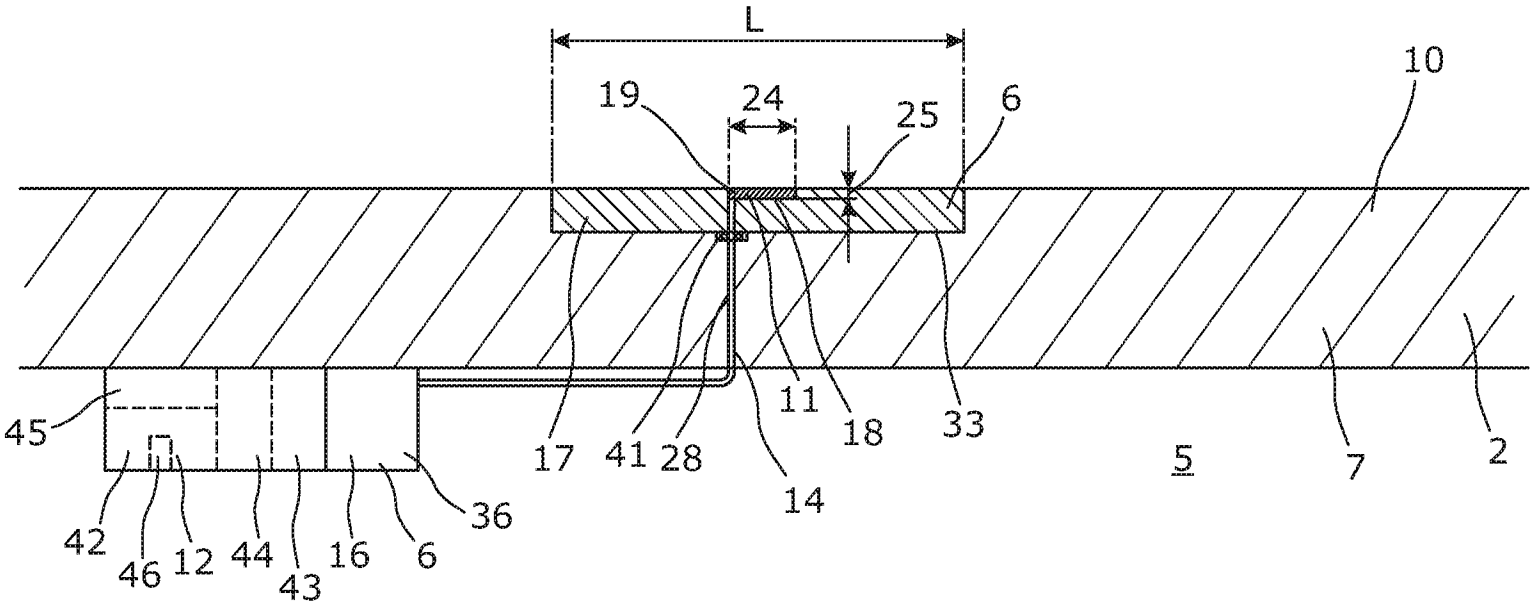
Figure 3:
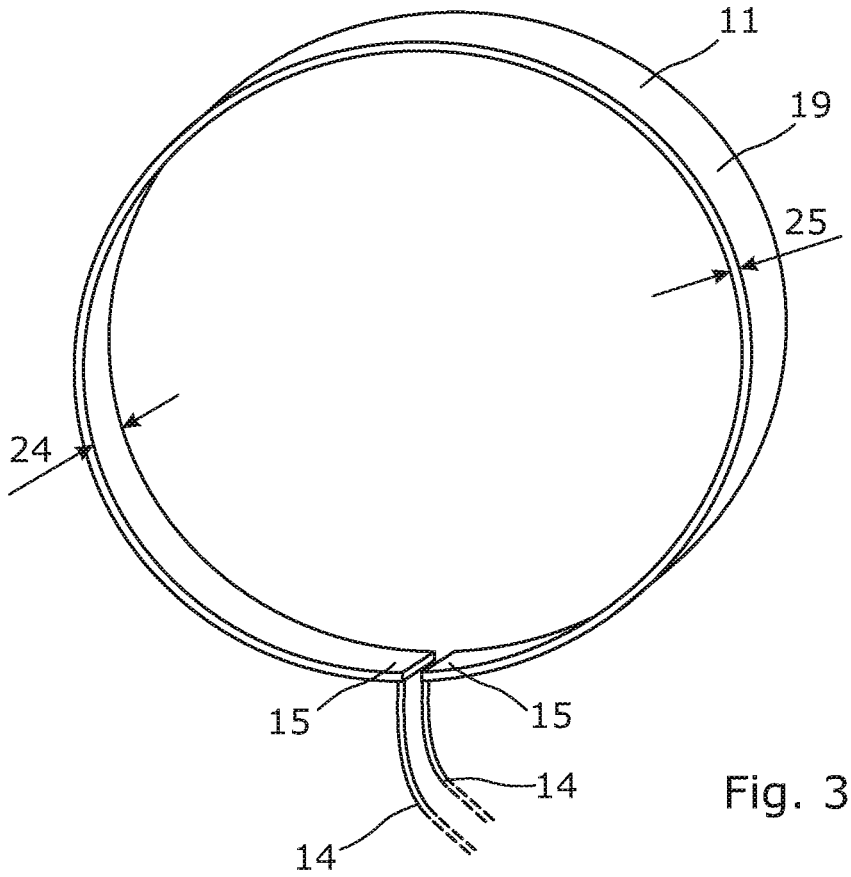
Figure 4:
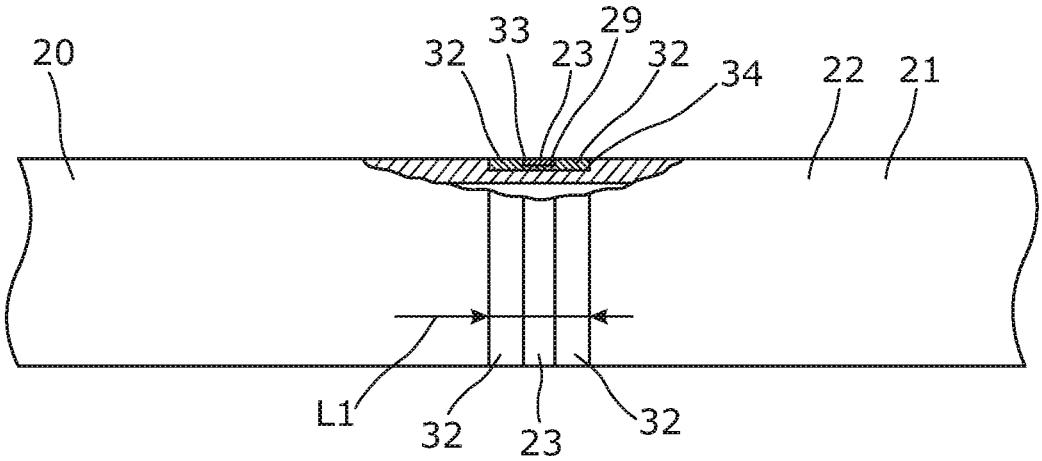
Figure 5:
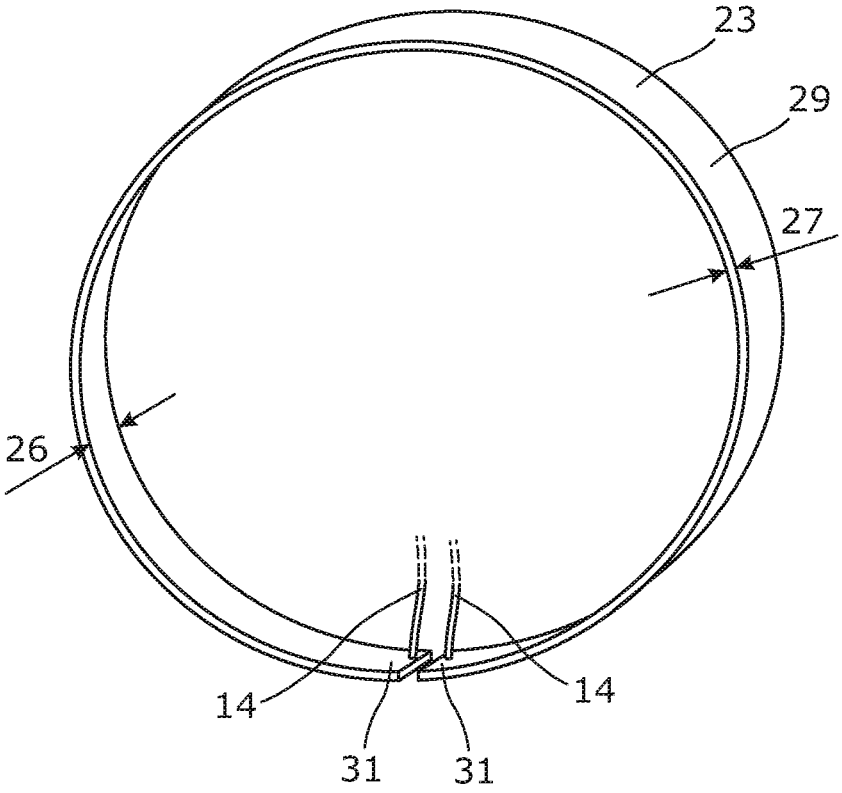
Figure 6A:
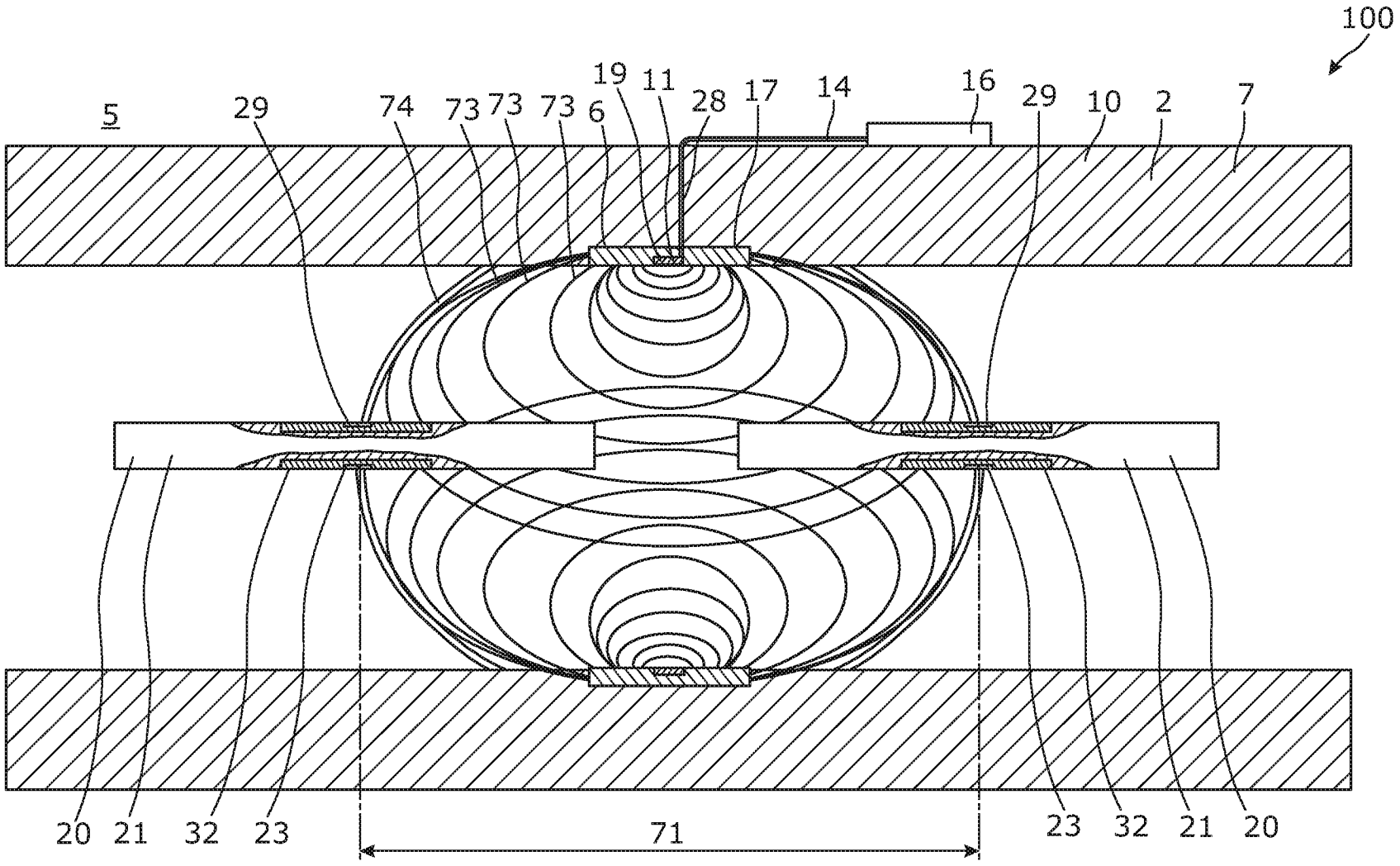
Figure 6B:
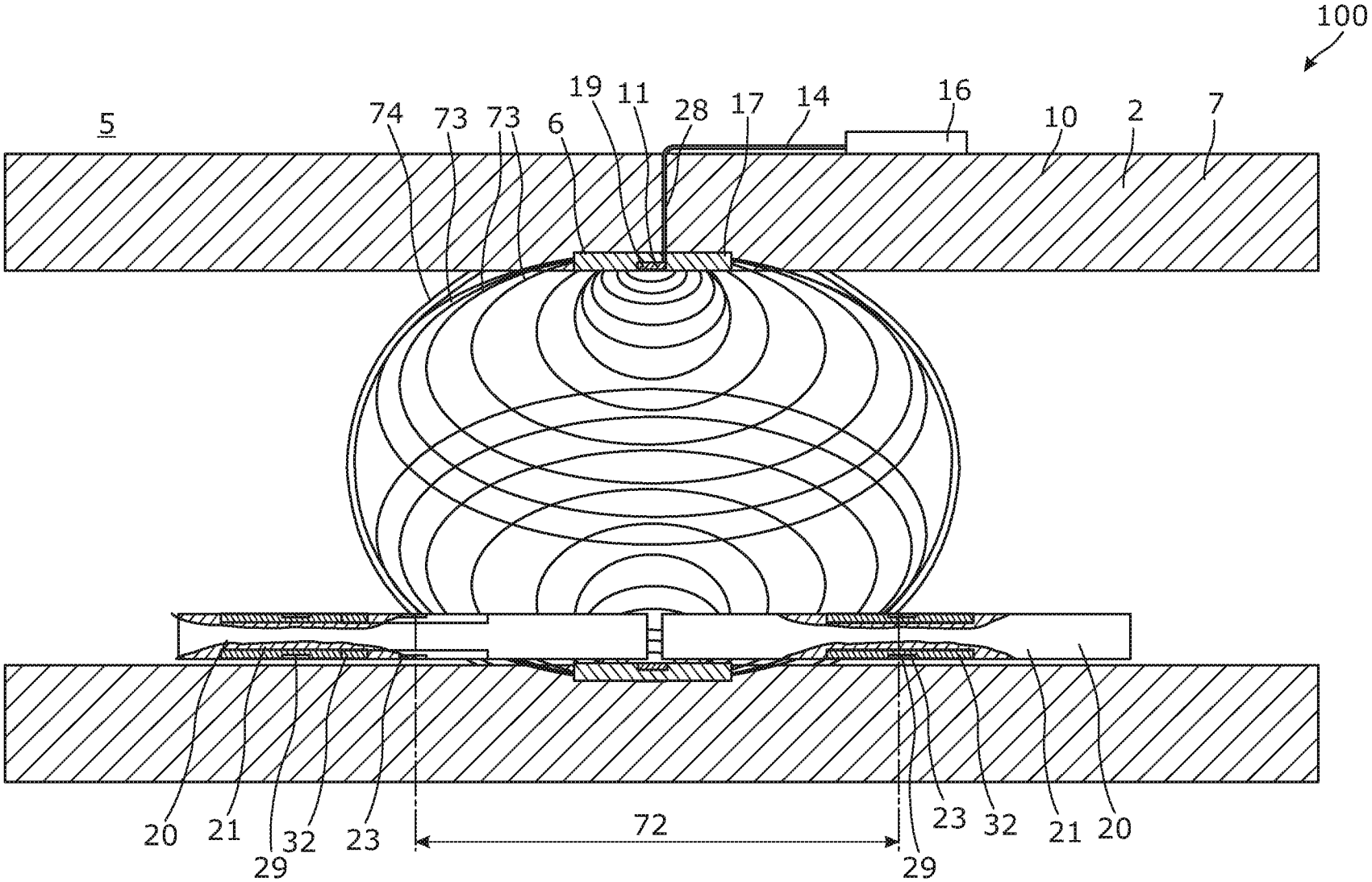
Figure 7:
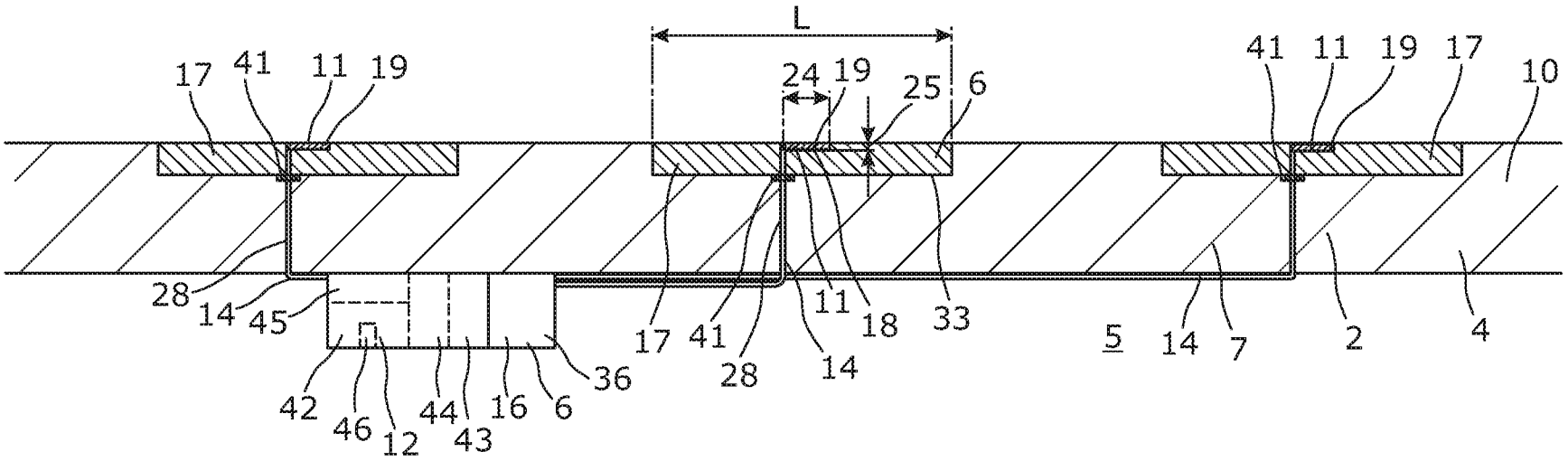
Figure 8:
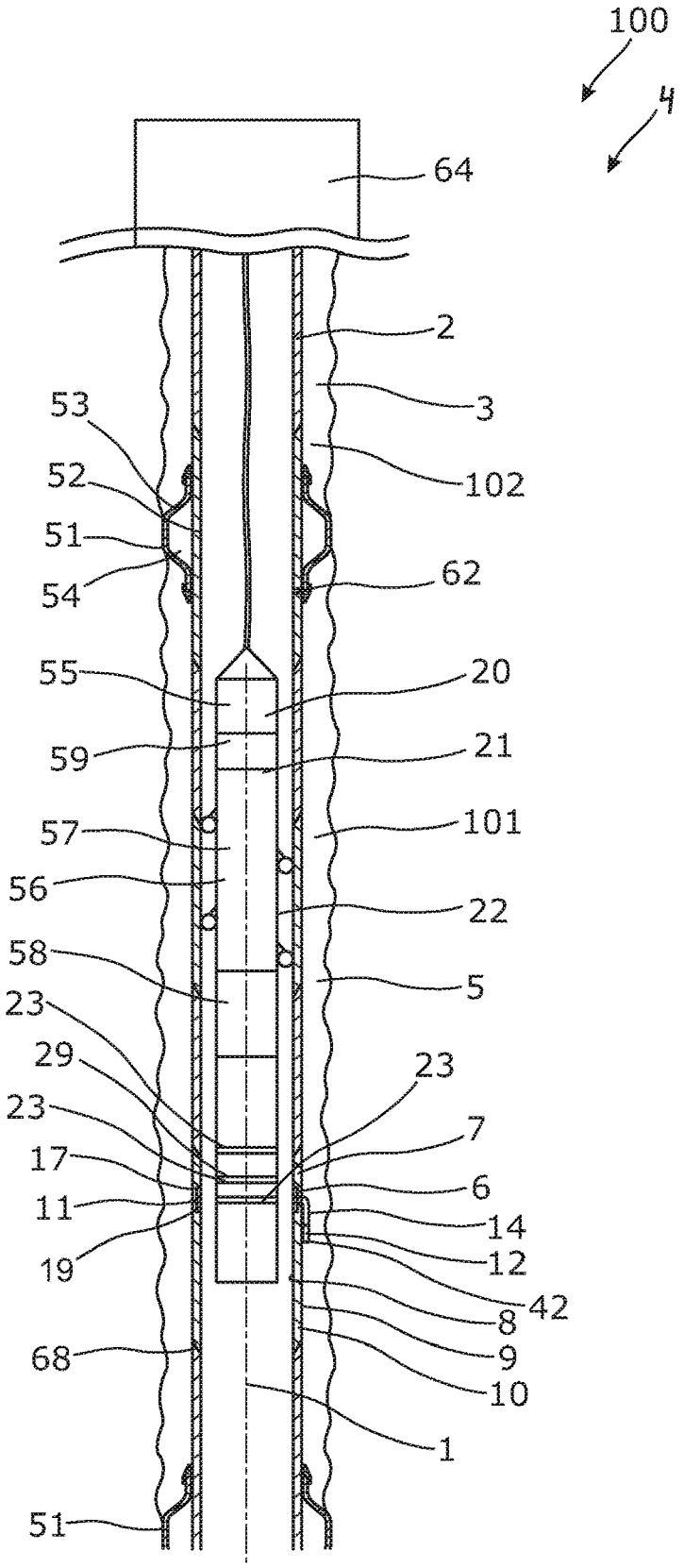

The invention and its many advantages will be described in more detail below with reference to the accompanying schematic drawings, which for the purpose of illustration show some non-limiting embodiments and in which:

FIG. 1 shows a partly cross-sectional view of a downhole transfer system,

FIG. 2 shows a partly cross-sectional view of part of a well tubular metal structure having a transceiver assembly, FIG. 3 shows an assembly conductive winding in perspective, FIG. 4 shows a partly cross-sectional view of part of a downhole tool, FIG. 5 shows a tool conductive winding in perspective, FIGS. 6A and 6B illustrate the magnetic flux lines generated by the assembly conductive winding during transfer of data from the tranceiver assembly to the downhole tool, FIG. 7 shows a partly cross-sectional view of part of a well tubular metal structure having a transceiver assembly having a plurality of assembly conductive windings, and FIG. 8 shows a partly cross-sectional view of another downhole transfer system.

All the figures are highly schematic and not necessarily to scale, and they show only those parts which are necessary to elucidate the invention, other parts being omitted or merely suggested.

FIG. 1 shows a downhole transfer system 100 for transferring data through a well tubular metal structure 2 arranged in a borehole 3 of a well 4. The downhole transfer system comprises the well tubular metal structure 2 having an axial direction 1 and arranged in the borehole providing an annulus 5 between the borehole and the well tubular metal structure. The downhole transfer system further comprises a transceiver assembly 6 comprising a tubular metal part 7, an assembly conductive winding 11 made from a conductor 19, and a power consuming device 12. The tubular metal part 7 is mounted as part of the well tubular metal structure, e.g. by means of threading 68, and the tubular metal part having an inner face 8, an outer face 9, and a wall 10. The assembly conductive winding 11, such as a copper ring, is connected with the inner face of the tubular metal part, e.g. in a groove of the tubular metal part. The power consuming device 12, e.g. a sensor unit, is arranged in the annulus and is connected with the outer face 9. The power consuming device 12 is connected to the assembly conductive winding 11 by means of an electrical conductor 14. The downhole transfer system 100 further comprises a downhole tool 20 comprising a tool body 21, a tool body outer face 22, and a tool conductive winding 23. As shown in FIG. 3, the assembly conductive winding 11 has an axial extension 24 along the axial direction 1 and a radial extension 25 perpendicular to the axial extension, and the axial extension being at least 50% larger the radial extension.

Thus, the assembly conductive winding 11 is made from a conductor 19, where the cross-section of the conductor has a rectangular shape so that the length of the rectangle is along the axial direction/extension of the well tubular metal structure and the smaller width of the rectangle is along the radial extension. Known windings are made from a conductor having a round cross-section and the conductor is wounded to have a lot of windings making up an electromagnetic coil.

By having an assembly conductive winding made from a conductor, which has a cross-sectional having substantially larger axial extension than the radial extension and a substantially larger axial extension than known coil windings, the resonance frequency of the assembly conductive winding is substantially larger than the resonance frequency of known coils and the transceiver assembly can therefore transmit and receive at a substantially higher frequency than known coils. This is due to the fact that it is only possible to transmit and receive data at a lower frequency than the resonance frequency of the transceiver system and thus if the resonance frequency of the coil is low then the possible transmitting/receiving frequency is even lower.

Furthermore, by having an assembly conductive winding made from a conductor having a rectangular cross-sectional shape, the resistance of the winding is minimized while maintaining the inductance constant. Inductance is defined by physical parameters i.e. the area the winding encloses, while the resistance is defined by the cross-sectional area of the conductor of the winding.

At high frequencies as used in the present system, a phenomenon called skin effect occurs which is a measure for how much of the winding is in fact used of the current conducted in the conductor/winding. By having a rectangular cross-sectional shape of the conductor of the winding, more of the winding is used.

As can be seen in FIG. 2, the conductor of the assembly conductive winding 11 has a rectangular cross-sectional shape. The axial extension is at least 3 mm, preferably more than 5 mm. The radial extension of the assembly conductive winding 11 is less than 1 mm, preferably less than 0.5 mm, and more preferably the radial extension is less than 0.2 mm. The radial extension of the conductor 19 of the assembly conductive winding 11 is preferably made as small as possible. The downhole transfer system has a resonance frequency above 14 MHz. The transmission between the tool conductive winding and the assembly conductive winding is at a frequency of at least 1 MHz, preferably at least 5 MHz, even more preferably at least 10 MHz. Thus, the data transfer can occur much faster than in the known system, transmitting at a frequency of 50 Hz than in the known system and the power transfer from the tool to the power consuming device can also occur much faster than in the known system without having to use electrical control lines. Thus, the design of the well can be more effective when electrical control lines can be avoided. In order to transfer even more power, a plurality of assembly conductive windings may be used, e.g. one for data communication and one for power transfer. The power and data will be transmitted instantaneously.

The downhole tool may be transmitting power and/or data at several frequencies, such as at 10-20 MHz, e.g. at 13.56 MHz, and at a lower frequency of 1 MHZ, so that if data at the high frequency is not received, the signals at the lower frequency will most likely be received and will confirm that the system works but that some adjustments are needed. One adjustment could be to decentralise the downhole tool, as shown in FIG. 6B. Often when a tool is transmitting and nothing is received, the operator is likely to conclude that the tool is not working and by transmitting power/data at even lower frequencies than 1 MHz besides the high frequencies of 10-20 MHz, the operator obtains information that the tool's transferring capability is poor if something is being transferred. Thus, by transmitting power or communicating at a lower frequency e.g. 1 MHz, this low frequency functions as a backup frequency.

The electrical conductor 14 extends through the wall 10 of the tubular metal part i.e. the wall of the well tubular metal structure 2 in a bore 28 to be connected to a housing 16 of a transceiver device 36 arranged on the outer face of the tubular metal part 7. The transceiver device 36 comprises the assembly conductive winding 11 even though it is arranged on the inner face of the tubular metal part.

The transceiver assembly of FIG. 2 further comprises an intermediate annular sleeve 17 having a groove 18 in which the assembly conductive winding is arranged so that the conductor 19 of the assembly conductive winding is arranged in the groove. The intermediate annular sleeve 17 is arranged in a groove 33 on the inner face 8 of the tubular metal part 7 and is arranged between the conductor of the assembly conductive winding 11 and the inner face. The intermediate annular sleeve 17 is of a material having a lower electrical conductivity than that of the assembly conductive winding and that of the well tubular metal structure/the tubular metal part, so that the intermediate annular sleeve hinders magnetic flux lines 73 (shown in FIGS. 6A and 6B) from extending through the tubular metal part being a part of the well tubular metal structure to avoid generation of Eddy currents. Eddy currents disturb both power transfer and data transfer, i.e. communication between the transceiver assembly and the tool. The intermediate annular sleeve is of a material having a high permeability to magnetic field lines.

Furthermore, the thinner the conductor of the assembly conductive winding is i.e. the radial extension the conductor of the assembly conductive winding is as small as possible, the less Eddy currents are generated in the assembly conductive winding when transmitting power or communicating data at alternating current (AC). The same applies to the tool conductive winding.

As shown in FIG. 2, the power consuming device may be a sensor unit 42. The sensor unit may be connected with the housing of the transceiver device but may be separated therefrom in another embodiment. The sensor unit 42 comprises a power supply 43, such as a battery, a fuel cell, but in another embodiment, the sensor unit is connected to an electrical control line (not shown) functioning as the power supply. The sensor unit further comprises a micro controller 44 and a storage unit 45. Furthermore, the sensor unit comprises a sensor 46, such as a temperature sensor, a pressure sensor, or a sensor measuring salinity, fluid content, density etc. The sensor unit may comprise several sensors, and/or several different sensors. In order to seal off the inside of the well tubular metal structure from the annulus, a sealing means 41 is arranged around the electrical conductors in the wall 10 of the tubular metal part 7.

When the downhole tool 20 is positioned within the magnetic flux envelope 74, shown in FIGS. 6A and 6B, the downhole tool may check the power level of the power supply such as the battery transceiver assembly.

In FIG. 2, the intermediate annular sleeve has a length L along the axial direction which is at least two times the axial extension of the conductor 19 of the assembly conductive winding 11. The intermediate annular sleeve is made of ferrite or the like material hindering magnetic flux lines from extending through the tubular metal part and the well tubular metal structure. In this way, Eddy currents are almost avoided and the data signal when downloading data from the sensor unit is a clear signal, which is easy to read. As shown in FIG. 6A, the magnetic flux lines 73 are directed radially inwards but the intermediate annular sleeve prevents the magnetic flux lines from entering the wall 10 of the tubular metal part 7.

As can seen in FIG. 2, the assembly conductive winding 11 is the outermost of the tubular metal part 7 and thus magnetic flux lines between the transceiver assembly and the tool are only hindered in the fluid flowing in the well tubular metal structure.

In another embodiment, the conductor 19 of the assembly conductive winding 11 and the intermediate annular sleeve may be arranged recessed i.e. arranged somewhat below the inner face to make room for a protective coating to protect against the well fluid.

In FIG. 3, the assembly conductive winding has substantially one turn, meaning that the conductor 19 of the assembly conductive winding 11 turns from 0° to be equal or less than 360°, thus the assembly conductive winding is a one-turn assembly conductive winding. The conductor of the assembly conductive winding is made of copper or similar conductive material. One end 15 of the assembly conductive winding is electrically connected to the electrical conductor 14 and the other end 15 of the assembly conductive winding is electrically connected to another electrical conductor 14. Each electrical conductor extends through the wall of the tubular metal part and is electrically connected to the housing arranged on the outer face of the tubular metal part/well tubular metal structure. The conductor of the assembly conductive winding has the shape of plate-shaped thin ring e.g. of copper, where the axial extension is more than 5 mm and the radial extension is less than 0.5 mm.

FIG. 4 shows part of the downhole tool 20 where a small part of the tool body is shown in a cross-sectional view to illustrate the position and configuration of the tool conductive winding 23. As shown in FIG. 5, the tool conductive winding 23 has a conductor 29 having an axial extension 26 along the axial direction and the conductor of the tool conductive winding has a radial extension 27 perpendicular to the axial extension. As shown in FIG. 4, the axial extension is at least 50% larger than the radial extension. The conductor of the tool conductive winding has a rectangular cross-sectional shape. The axial extension of the conductor of the tool conductive winding is at least 3 mm, preferably more than 5 mm. The radial extension of the conductor of the tool conductive winding is less than 1 mm, preferably less than 0.5 mm, and more preferably the radial extension is less than 0.2 mm. The radial extension of the conductor of the tool conductive winding is preferably made as small as possible.

The downhole tool of FIG. 4 further comprises an intermediate annular sleeve 32 having a groove 33 in which the conductor of the tool conductive winding is arranged. The intermediate annular sleeve 32 is arranged in a groove 34 on the tool body outer face 22 of the tool body 21 and is thus arranged between the tool conductive winding 23 and the tool body outer face. The intermediate annular sleeve 32 is of a material having a lower electrical conductivity than that of the conductor of the tool conductive winding, so that the intermediate annular sleeve 32 hinders magnetic flux lines 73 (shown in FIGS. 6A and 6B) from extending through the tool body to avoid generation of Eddy currents. The intermediate annular sleeve 32 is made of ferrite or the like material hindering magnetic flux lines from extending through the tool body. In this way, Eddy currents are almost avoided and the data signal when downloading data from the sensor unit is a clear signal, which is easy to read without having to use complex noise filtering. As shown in FIG. 6A, the magnetic flux lines 73 are directed radially inwards but the intermediate annular sleeve prevents the magnetic flux lines from entering the wall of the tool body.

As can seen in FIG. 4, the conductor of the tool conductive winding 23 is part of the outermost of the tool body and thus magnetic flux lines between the transceiver assembly and the downhole tool 20 are only hindered in the fluid flowing in the well tubular metal structure.

In FIG. 5, the downhole tool conductive winding 23 has substantially one turn, meaning that the conductor of the tool conductive winding turns from 0° to be equal or less than 360°, thus the tool conductive winding is a one-turn tool conductive winding. The assembly conductive winding is made of copper or similar conductive material. One end 31 of the tool conductive winding is electrically connected to the electrical conductor 14 and the other end 31 of the tool conductive winding is electrically connected to another electrical conductor 14. Each electrical conductor 14 extends into the tool body.

FIGS. 6A and 6B illustrate the magnetic flux lines generated by the assembly conductive one-turn winding 11 during transfer of data from the tranceiver assembly to the downhole tool. The magnetic flux lines generated by the assembly conductive one-turn winding 11 extend radially into the well tubular metal structure 2 providing a magnetic flux envelope 74 defining the area in which a sufficient transfer may occur. Due to the fact that the conductor of the assembly conductive winding is generating magnetic flux lines along the entire inner circumference of the well tubular metal structure/the tubular metal part, the magnetic flux, i.e. the signal, is more uniform in the centre of the well tubular metal structure/the tubular metal part than near the inner face thereof. In FIG. 6A, the downhole tool 20 is centralised and the downhole tool is shown in its two outer positions which indicate the maximum transferring range 71 when the tool conductive one-turn winding 23 is able to transmit and/or receive power and/or data from the assembly conductive one-turn winding 11. In FIG. 6B, the downhole tool 20 is decentralised and the downhole tool is shown in its two outer positions which indicate the maximum transferring range 72 when the tool conductive one-turn winding 23 is able to transmit and/or receive power and/or data from the assembly conductive one-turn winding 11. As shown in FIG. 6B, the transferring range 72 for a decentralised tool is smaller than the transferring range 71 for a centralised tool, as shown in FIG. 6A. Thus, a centralised downhole tool has a longer distance to the conductor of the assembly conductive winding, however, the tool is within the magnetic flux envelope 74 for a longer period and can therefore transmit and/or receive over a longer axial distance. Thus, the centralised tool may be able to move faster than the decentralised downhole tool depending on the loss of fluid in the well tubular metal structure between the downhole tool and the transceiver assembly. If the fluid is of such composition that the fluid in the well tubular metal structure decreases the transmitting capability between the winding too much, the downhole tool should be decentralised when passing the transceiver assemblies.

In FIG. 7, the well tubular metal structure further comprises three assembly conductive windings, where each end, i.e. each of six ends, is electrically connected to the housing 16 arranged on the outer face via electrical conductors for powering the sensor unit or receiving data from the sensor unit 42. Thus, the transceiver assembly comprises a plurality of one-turn assembly conductive windings 11. Each of the plurality of one-turn assembly conductive windings is arranged in a groove of an intermediate annular sleeve 17. By having a plurality of assembly windings, power or data can be transmitted and received over a longer part of the well tubular metal structure and thus the downhole tool can transmit and/or receive power and/or data even travelling at a higher speed than if the well tubular metal structure had only one transceiver assembly.

The downhole tool of FIG. 8 comprises a plurality of one-turn tool conductive windings where each is arranged in a groove of an intermediate annular sleeve. In FIG. 1, the downhole tool 20 is connected to surface via wireline 47 and thus being a wireline downhole tool, and in FIG. 8, the downhole tool comprises a battery 55 and the downhole tool is a wireless downhole tool moving autonomously in the well. The downhole tool comprises a centraliser 56 to centralise the downhole tool in the well, as shown in FIG. 6A. The centraliser in FIG. 8 is a downhole tractor 57, which can also propel the downhole tool forward in the well, i.e. be self-propelling. The downhole tool further comprises a storage means 58 and an electronic control module 59.

Even though not illustrated, the conductor of the assembly conductive winding and the intermediate annular sleeve may be embedded in a permanent coating such as epoxy, rubber, etc. Furthermore, the conductor of the tool conductive winding and the intermediate annular sleeve may be embedded in a permanent coating such as epoxy, rubber, etc.

The downhole transfer system of FIGS. 1 and 8 has a well tubular metal structure which comprises annular barriers 51 configured to be expanded in the annulus providing isolation between a first zone 101 and a second zone 102. Each annular barrier comprises a barrier tubular metal part 52 mounted as part of the well tubular metal structure 2. Each annular barrier further comprises an expandable metal sleeve 53 surrounding and connected with the barrier tubular metal part providing an annular space 54 in which fluid may enter an opening 62 in the barrier tubular metal part to expand the expandable metal sleeve. The power consuming device 12 is a sensor unit 42 and is arranged in the annulus and configured to measure a property, such as temperature or pressure, on one side of the annular barrier or within the annular barrier.

By fluid or well fluid is meant any kind of fluid that may be present in oil or gas wells downhole, such as natural gas, oil, oil mud, crude oil, water, etc., or even H2S. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By an annular barrier is meant an annular barrier comprising a tubular metal part mounted as part of the well tubular metal structure and an expandable metal sleeve surrounding and connected to the tubular part defining an annular barrier space.

By a casing, liner, tubular structure or well tubular metal structure is meant any kind of pipe, tubing, tubular, liner, string etc. used downhole in relation to oil or natural gas production.

In the event that the downhole tool is not submergible all the way into the casing, a downhole tractor can be used to push the downhole tool all the way into position in the well. The downhole tractor may have projectable arms having wheels, wherein the wheels contact the inner surface of the casing for propelling the tractor and the downhole tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole transfer system for transferring data through a well tubular metal structure arranged in a borehole of a well, comprising:

a well tubular metal structure having an axial direction and being arranged in the borehole providing an annulus between the borehole and the well tubular metal structure, a transceiver assembly fixed to the well tubular metal structure, the transceiver assembly comprising:

a tubular metal part mounted as part of the well tubular metal structure, the tubular metal part having an inner face, an outer face, and a wall, an assembly conductive winding made from a conductor connected with and positioned at the inner face and exposed to an interior of the well tubular metal structure, the conductor being configured to generate magnetic flux within the tubular metal part, and a power consuming device arranged in the annulus and connected the outer face, and the power consuming device being connected to the assembly conductive winding by means of an electrical conductor passing through the wall of the tubular metal part, a downhole tool comprises a tool body, a tool body outer face, and a tool conductive winding made from a tool body conductor configured to wirelessly receive a signal from the power consuming device due to proximity to the magnetic flux generated by the conductor of the assembly conductive wiring, the transceiver assembly being configured to remain fixed to the well tubular metal structure when the downhole tool is removed from the well, wherein the conductor of the assembly conductive winding has a cross-sectional shape having an axial extension along the axial direction and a radial extension perpendicular to the axial extension, the axial extension being at least 50% larger than the radial extension.

2. A downhole transfer system according to claim 1, wherein the conductor of the assembly conductive winding is a ring having a rectangular cross-sectional shape.

3. A downhole transfer system according to claim 1, wherein the axial extension is at least 3 mm.

4. A downhole transfer system according to claim 3, wherein the axial extension is at more than 5 mm.

5. A downhole transfer system according to claim 1, wherein the radial extension is less than 1 mm.

6. A downhole transfer system according to claim 1, wherein the assembly conductive winding has substantially one turn, so that the conductor of the assembly conductive winding turns from 0° to be equal or less than 360°.

7. A downhole transfer system according to claim 1, wherein the transceiver assembly further comprises an intermediate annular sleeve having a groove in which the conductor of the assembly conductive winding is arranged, the intermediate annular sleeve is arranged on the inner face of the tubular metal part and is arranged between the conductor of the assembly conductive winding and the inner face, the intermediate annular sleeve is of a material having a lower electrical conductivity than that of the assembly conductive winding.

8. A downhole transfer system according to claim 7, wherein the intermediate annular sleeve has a length along the axial direction being at least two times the axial extension of the conductor of the assembly conductive winding.

9. A downhole transfer system according to claim 7, wherein the intermediate annular sleeve is made of ferrite hindering magnetic flux lines from extending through the tubular metal part and the well tubular metal structure.

10. A downhole transfer system according to claim 7, wherein the intermediate annular sleeve hinders magnetic flux lines from extending through the tubular metal part and the well tubular metal structure to avoid generation of Eddy currents.

11. A downhole transfer system according to claim 1, wherein transmission between the tool conductive winding and the assembly conductive winding is at a frequency of at least 1 MHz.

12. A downhole transfer system according to claim 11, wherein the frequency is at least 5 Hz.

13. A downhole transfer system according to claim 11, wherein the frequency is at least 10 Hz.

14. A downhole transfer system according to claim 1, wherein the conductor of the tool conductive winding has a rectangular cross-sectional shape having an axial extension along the axial direction and a radial extension, the axial extension being at least 50% larger than the radial extension.

15. A downhole transfer system according to claim 1, further comprising a seal arranged around the electrical conductors in the wall.

16. A downhole transfer system according to claim 1, wherein the power consuming device is a sensor unit.

17. A downhole transfer system according to claim 1, wherein the well tubular metal structure comprises annular barriers configured to be expanded in the annulus providing isolation between a first zone and a second zone, each annular barrier comprises a barrier tubular metal part mounted as part of the well tubular metal structure, an expandable metal sleeve surrounding and connected with the barrier tubular metal part providing an annular space in which fluid may enter an opening in the barrier tubular metal part to expand the expandable metal sleeve.

18. A downhole transfer system according to claim 17, wherein the power consuming devices is a sensor unit and the sensor unit is arranged in the annulus and configured to measure a property on one side of an annular barrier or within the annular barrier.

19. A downhole transfer system according to claim 1, wherein the conductor of the assembly conductive wiring is flush with the inner face of the tubular metal part.

20. A downhole transfer system according to claim 1, wherein the magnetic flux includes lines configured to extend along the entire circumference of the tubular metal part.

* * * * *